US012054991B2

(12) United States Patent
Hammargren

(10) Patent No.: US 12,054,991 B2
(45) Date of Patent: Aug. 6, 2024

(54) CARVED OUT DRILL BIT

(71) Applicant: SANDVIK MINING AND CONSTRUTION TOOLS AB, Sandviken (SE)

(72) Inventor: John Hammargren, Sandviken (SE)

(73) Assignee: SANDVIK MINING AND CONSTRUCTIN TOOLS AB, Sandviken (SE)

( * ) Notice: Subject to any disclaimer, the term of this patent is extended or adjusted under 35 U.S.C. 154(b) by 4 days.

(21) Appl. No.: 18/022,248

(22) PCT Filed: Aug. 23, 2021

(86) PCT No.: PCT/EP2021/073237
§ 371 (c)(1),
(2) Date: Feb. 20, 2023

(87) PCT Pub. No.: WO2022/043246
PCT Pub. Date: Mar. 3, 2022

(65) Prior Publication Data

US 2024/0011355 A1 Jan. 11, 2024

(30) Foreign Application Priority Data

Aug. 26, 2020 (EP) ..... 20192805

(51) Int. Cl.
*E21B 10/38* (2006.01)
*E21B 10/36* (2006.01)
*E21B 10/56* (2006.01)

(52) U.S. Cl.
CPC ..... *E21B 10/38* (2013.01); *E21B 10/36* (2013.01); *E21B 10/56* (2013.01)

(58) Field of Classification Search
CPC ..... A61B 17/1615; B23K 2101/002; E21B 10/36; E21B 10/38; E21B 10/56
See application file for complete search history.

(56) References Cited

U.S. PATENT DOCUMENTS 3,357,507 A * 12/1967 Stewart ..... E21B 10/56 175/426
4,202,421 A * 5/1980 Pinck ..... E21B 10/40 175/398

(Continued)

FOREIGN PATENT DOCUMENTS

WO 2005056972 A1 6/2005
WO 2016030036 A1 3/2016

*Primary Examiner* — Blake Michener
(74) *Attorney, Agent, or Firm* — Corinne R. Gorski

(57) ABSTRACT

A drill bit includes a shank and drill bit head, which are both centered on a longitudinal axis, a gauge, and a front face with a peripheral edge adjacent to the gauge. An area within the peripheral edge defines a total area of the front face. The front face includes a central island at its radially innermost section, a plurality of peripheral platforms at its radially outermost section adjacent to the peripheral edge, and a recessed section positioned radially between the central island and the peripheral platforms. The central island and the peripheral platforms are axially raised compared to the recessed section. A plurality of inner front inserts are positioned on the central island and at least one outer front insert is positioned on each of the peripheral platforms. The area of the recessed section is >62% of the area of the total area of the front face.

15 Claims, 3 Drawing Sheets

(56) References Cited

U.S. PATENT DOCUMENTS

| | | | | |
|---|---|---|---|---|
| 10,501,997 | B2 * | 12/2019 | Rindeskar | E21B 10/38 |
| 10,626,680 | B2 * | 4/2020 | Rindeskar | E21B 10/38 |
| 2016/0348442 | A1 | 12/2016 | Rindeskar et al. | |
| 2017/0268295 | A1 * | 9/2017 | Rindeskär | E21B 10/36 |

* cited by examiner

CARVED OUT DRILL BIT

RELATED APPLICATION DATA

This application is a § 371 National Stage Application of PCT International Application No. PCT/EP2021/073237 filed Aug. 23, 2021 claiming priority to EP 20192805.8 filed Aug. 26, 2020.

TECHNICAL FIELD

The present invention relates to drill bits for percussive rock drilling tools and, more particularly, to such drill bits that use hard inserts.

BACKGROUND

Percussion drill bits are widely used both for drilling relatively shallow bores in hard rock and for creating deep boreholes. For the latter application, drill strings are typically used in which a plurality of rods are interconnected to advance the drill bit and increase the depth of the hole. In 'top hammer drilling' a terrestrial machine is operative to transfer a combined impact and rotary drive motion to an upper end of the drill string whilst a drill bit positioned at the lower end is operative to crush the rock and form the boreholes. In 'down the hole' drilling the impact is delivered not through the upper end of the string, but by a hammer directly connected to the drill bit within the hole.

The drill bit typically comprises a drill head that mounts a plurality of hard cutting inserts, commonly referred to as buttons. Such inserts comprise a carbide based material to enhance the lifetime of the drill bit. Conventionally, the drill bit comprises a plurality of gauge inserts distributed circumferentially at an outer perimeter of the head that are configured to engage material to be crushed and to determine the diameter of the borehole. The head also mounts a plurality of front inserts provided at a front face of the head for engaging material to be crushed at the axial forwardmost region of drilling. One or more flow openings ordinarily extends through the length of the drill bit and leads to a flow channel formed in the front surface of the drill bit head. Flushing fluid is introduced to the drilling site through a drill tube attached to the drill bit and debris is flushed from the drilling site via axially extending grooves formed along the sides of the drill bit head.

The problem is that as the cutting inserts are worn down the steel on the front face of the drill comes into contact with the rock being drilled. This is not desirable because then the rock being drilled will not break the rock in an efficient way and consequently the rate of drilling will be decreased.

Some known designs have the front inserts that are arranged such that there is a plurality of inner front inserts positioned on a raised central island and a plurality of outer front inserts positioned on raised outer front face sections with a recessed section positioned therebetween which connects to the grooves on the sides of the drill bit head to facilitate the flushing of the debris from the front face of the drill bit and to avoid steel contact with the rock as the inserts are worn away. However, there is still a need to further improve the avoidance of steel contact to further improve drilling efficiency.

SUMMARY

It is an objective of this invention to provide a novel and improved design that reduces the risk of steel contact with the rock as the inserts are worn away. This objective is achieved by providing a drill bit comprising a shank and a drill bit head which are both centred on a longitudinal axis; wherein the drill bit head has a gauge and a front face with a peripheral edge which is adjacent to the gauge, the peripheral edge having a diameter D1, the area within the peripheral edge defining the total area of the front face; wherein the front face has a central island at its radially innermost section, a plurality of peripheral platforms at its radially outermost section adjacent to the peripheral edge and a recessed section positioned radially between the central island and the peripheral platforms; wherein the central island and the peripheral platforms are axially raised in comparison to the recessed section; wherein a plurality of inner front inserts are positioned on the central island and at least one outer front insert is positioned on each of the peripheral platforms; characterized in that: the area of the recessed section is >62% of the area of the total area of the front face.

Advantageously, by recessing or carving out an increased area of steel on the front face of the drill bit as the inserts are worn down there is a reduced risk of steel contact with the rock. It is preferable to avoid steel contact with the rock because it will have a negative impact on the drilling performance.

Preferably, the area of the recessed section is >63% of the area of the total area of the front face of the drill bit head. Advantageously, this further reduces the risk of steel contact.

Preferably, the area of the recessed section is <80% of the area of the total area of the front face of the drill bit head. Advantageously, this will provide better support for the inserts, which will reduce the risk of the inserts becoming detached.

Preferably, the recessed section extends in between each of the outer front inserts on each of the peripheral platforms to a recessed section outer edge having a diameter, D2, wherein D2 is >70%, more preferably >80% of D1. Advantageously, this means that more steel from the front face is removed and therefore the chance of the steel contact with the rock as the inserts are worn down in reduced.

Optionally, D2 is up to 100% of D1, in other words D2 could equal D1. Advantageously, the maximum area of the steel is therefore removed and so the risk of steel contact with the rock is further reduced.

Preferably, the recessed section extends in between each of the inner front inserts on the peripheral platforms to a recessed section inner edge having a diameter, D3, wherein D3 is <40% preferably <32% of D1. Advantageously, this means that more steel from the front face is removed and therefore the chance of the steel contact with the rock as the inserts are worn down is reduced.

Preferably, D3 is >10%, more preferably >15% of D1. Advantageously, this means there is sufficient steel surrounding the inserts to hold them securely in place.

Preferably, the recessed section is at least 1.0 mm from the inserts. Advantageously, this ensures there is sufficient steel surrounding each of the inserts to keep them securely held in position.

Preferably, the gauge has a side surface and wherein an angle, a, between the axis and the side surface is ≥5°, more preferably ≥6°. Advantageously, this increases the clearance between the steel and the rock which reduces the occurrence of anti-taper which would occur if the steel contacts the rock as the gauge inserts are worn away.

Preferably, α is ≤12°, more preferably ≤9°. Advantageously, this provides good support between the gauge insert hole and the side surface of the gauge.

Preferably, there are between 2 and 4, more preferably 3 inner front inserts positioned on the central island. Advantageously, this ensures there is sufficient coverage of the front face with inserts.

Preferably, there are between 1 and 3, more preferably 2 outer front face inserts positioned on each of the peripheral platforms. Advantageously, this ensures there is sufficient coverage of the front face with inserts.

Preferably, there are between 3 and 8 outer peripheral platforms. Advantageously, this ensures there is sufficient coverage of the front face with inserts.

Preferably, the peripheral platform has a width of less than 2.5 mm, preferably less than 2.0 mm, around at least 10%, preferably at least 20% of the circumference of each of the outer front inserts.

Preferably, the central island has a width of less than 2.5 mm, preferably less than 2.0 mm around at least 50%, preferably around at least 60% of the circumference of each of the inner front inserts.

BRIEF DESCRIPTION OF THE DRAWING

A specific implementation of the present invention will now be described, by way of example only, and with reference to the accompanying drawings.

DETAILED DESCRIPTION

Figure 1:
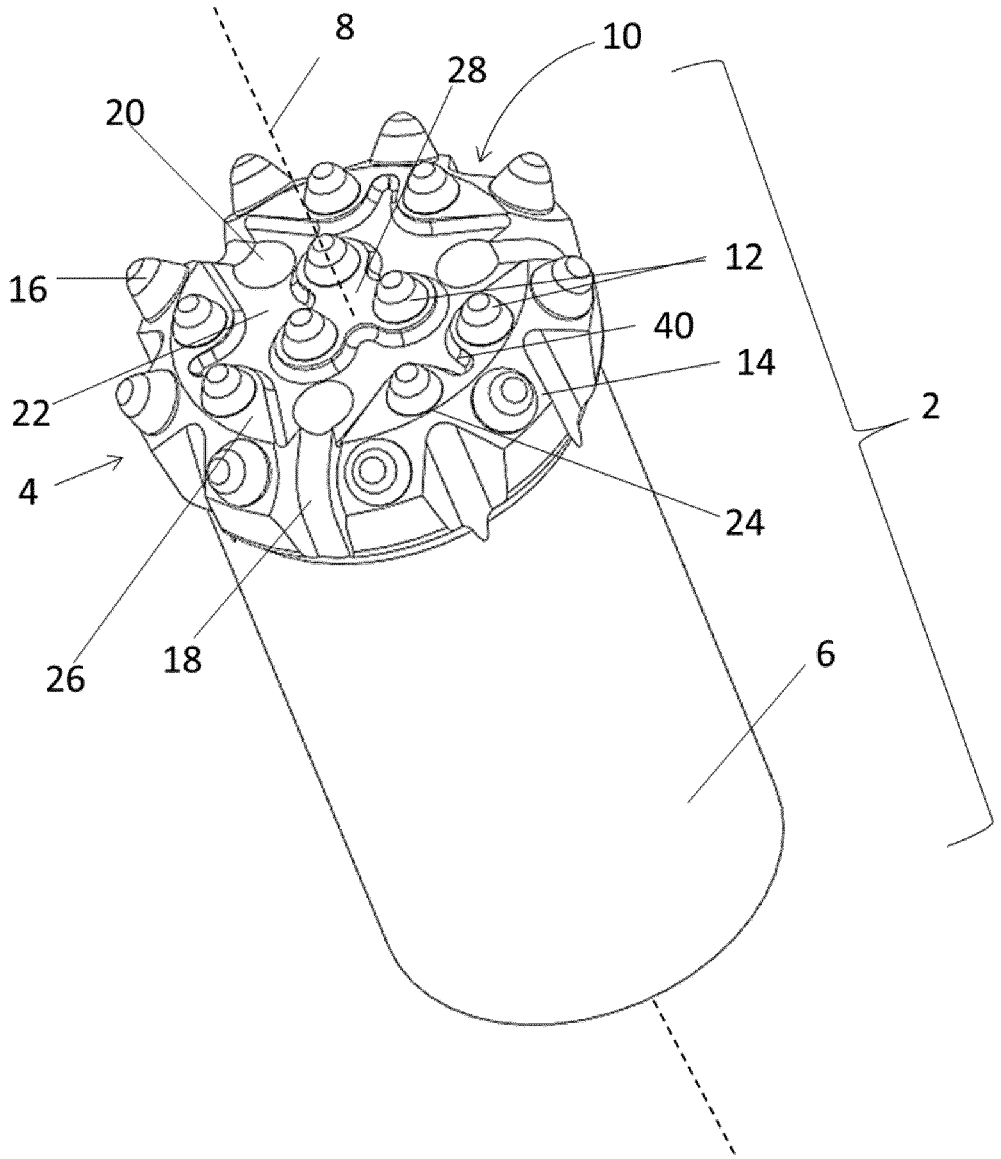
FIG. 1: Perspective view of a drill bit.

FIG. 1 shows a drill bit 2 comprising a drill bit head 4 and a shank 6, both of which are centred on a longitudinal axis 8. The head 4 has a front face 10 which defines the forward-most end of the head 4. The front face is normally conical or frustoconical, but can also be any other shape such as flat, drop centre or concave. A plurality of holes are provided on the front face 10 for receiving front inserts 12 (otherwise known as buttons), the inserts 12 normally having a generally domed shape, but could have axially forward cutting tips that are rounded, conical, ballistic, semi-spherical, flat or pointed. The inserts 12 are embedded in the drill bit head so as to stand axially proud of front face 10. The inserts 12 are made of an extremely hard material, such as cemented carbide, while the rest of the drill bit 2 will be made of a different material, typically steel.

A gauge 14 surrounds the front face 10, a plurality of holes are provided on the gauge 14 for receiving gauge inserts 16 which form a peripheral ring around the drill bit head 4. Gauge inserts 16 are tilted radially outward so as to be generally inclined and outward facing from axis 8. Grooves 18 (otherwise known as chipways) are provided in areas between adjacent peripheral gauge inserts 16 through which flush medium can pass.

The rock drill bit 2 is to be coupled to a drill tube or a drill rod in a drill string by means of a threaded connection, not shown, or to a driver sub of a down-the-hole hammer, not shown, so as to transfer rotational movement in the usual manner. The tube or rod includes a channel for conveying a flush medium to the inside of the drill bit 2 and then to the front face 10 via flush holes 20 which are positioned a recessed section 22. The recessed section 22 is in communication with the grooves 18. In other words, the recessed section 22 is effectively a section of the front face 10 that has been carved away. The flush medium, which is commonly water or air, then flushes debris from the recessed section 22 on the front face 10 into the grooves 18 for removal.

The front face 10 has a peripheral edge 24 adjacent to the gauge 14, having a diameter D1. Extending from the peripheral edge 24, between each of the grooves 18, there are peripheral platforms 26 (otherwise known as outer islands or raised outer front face sections), that are axially raised in comparison to the recessed section 22 so that they are upstanding from it. FIG. 1 shows that there are three peripheral platforms 26 with the recessed section 22 projecting between each peripheral platform 26, but there could be a different number of peripheral platforms 26, such as two, four or five. The front face 10 also has a central island 28 (otherwise known as a central platform), which is also axially raised in comparison to or upstanding from the recessed section 22. In one embodiment the central island 28 is aligned substantially perpendicular to axis 8, whereas the outer peripheral platforms 26 are chamfered to taper rearwardly relative to axis 8 so as to be declined relative to the central island 28. The recessed section 22, which is positioned radially between the central island 28 and the peripheral platforms 26 are also chamfered to taper radially relative to the axis 8 so as to be declined relative to the central island 28, but the declined angle by which the recessed section 22 extends from the axis 8 is less than the corresponding angle by which the peripheral platforms 26 extend relative to the axis 8, meaning the front face 10 is essentially domed shaped. Accordingly, collectively the central island 28, the recessed section 22 and the outer islands 26 form a generally convex or flat front face 10 that projects forward from the perimeter edge 24.

Compared to known designs, the area of the recessed section 22 has been increased. The total area of the front face 10 is considered to the area up to the peripheral edge 24. In one embodiment of the present invention, the area of the recessed section 22 is >62% of the total of the total area of the front face 10, preferably >63%, even more preferably >64%. In other words more than 62% of the total area of the front face 10 has been axially carved out.

In one embodiment, the area of the recessed section 22 is <80%, preferably <75% of the total of the total area of the front face 10.

The depth of the recessed section 22 relative to the central island is typically about 1-7 mm, such as about 3 mm. Optionally, a transition region 40, positioned between the central island 28 and the recessed section 22 or between the peripheral platform 26 optionally has a radius or is chamfered.

Figure 2:
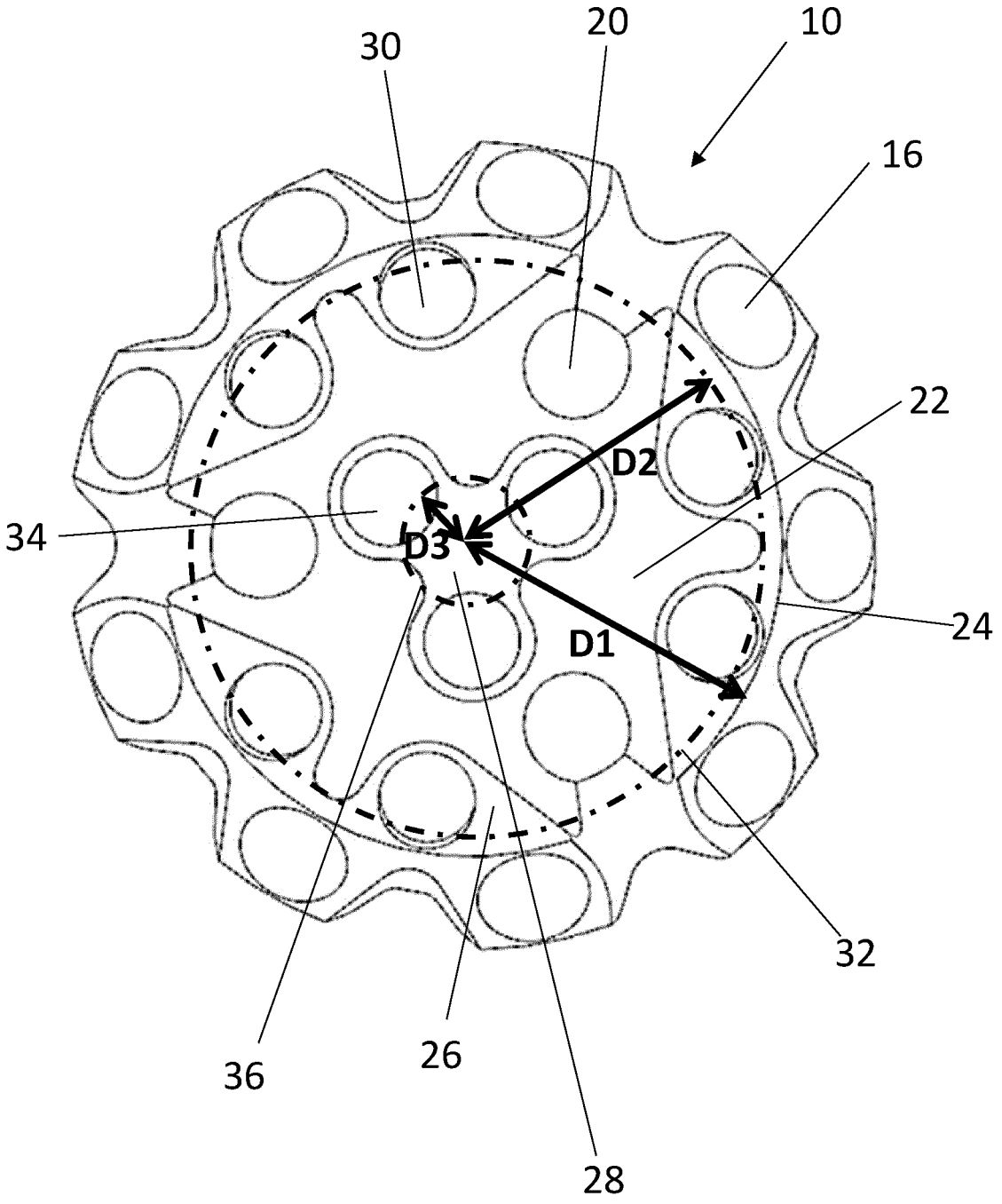
FIG. 2: Top down view of the front face of a drill bit head.

FIG. 2 shows that a plurality of outer front inserts 30 are positioned on each of the peripheral platforms 26, usually two outer front inserts 30 on each peripheral platform 26, but could be a different number, such as one or three. The peripheral platform 26 is the steel surrounding the outer front inserts 30. The outer front inserts 30 could be positioned at the same or different radial distances from the axis 8. The recessed section 22 extends in between each of the outer front inserts 30 to a recessed section outer edge 32 having a diameter D2. In one embodiment, D2 is at least 70%, preferably at least 80% of D1. Preferably, the area recessed section 22 should be as larger as possible, i.e. the amount of steel carved out in between each adjacent outer front face insert 30 should be as large as possible, but leaving at least 1.0 mm, such as between 1.0 and 5.0 mm raised around the circumference of each insert, i.e. not recessed around the edge of each outer front insert 30. D2 could be up to 100% of D1, in other words D1 and D2 could be equal. Typically there are three peripheral platforms 26, but there could be a different number, such as between 3 and 8.

A plurality of inner front inserts 34 are positioned on the central island 28, typically there are three inner front inserts 34, but there could also be a different number of inner front inserts 34, such as two or four. Preferably, the inner front inserts 34 are positioned at the same radial distance from the axis 8, but they could also be positioned at different radial distances from the axis 8, with a maximum distance of 6 mm from each other. The central island 28 is the steel surrounding the inner front inserts 34. The recessed section 22 extends in between each of the inner front inserts 34 to a recessed section inner edge 36 having a diameter D3. In one embodiment, D3 is less than 40%, preferably less than 32% of D1. In one embodiment, D3 is greater than 10%, preferably greater than 15%. Preferably, the area recessed section 22 should be as large as possible, i.e. the amount of steel carved out in between each pair of adjacent inner front face inserts 36 should be as large as possible, but leaving at least 1.0 mm of raised steel around the circumference of each inner front face insert 36, i.e. not recessed around the edge of each outer front face insert 30. Preferably, there is no more than 5.0 mm of raised steel around the circumference of each front face insert 30.

In one embodiment the peripheral platform 26 has a width of less than 2.5 mm, preferably 2.0 mm around at least 10%, preferably 20% of the circumference of each of the outer front inserts 30. In one embodiment the central island 28 has a width of less than 2.5 mm, preferably 2.0 mm around at least 50%, preferably around 60% of the circumference of each of the inner front inserts 34.

Figure 3:
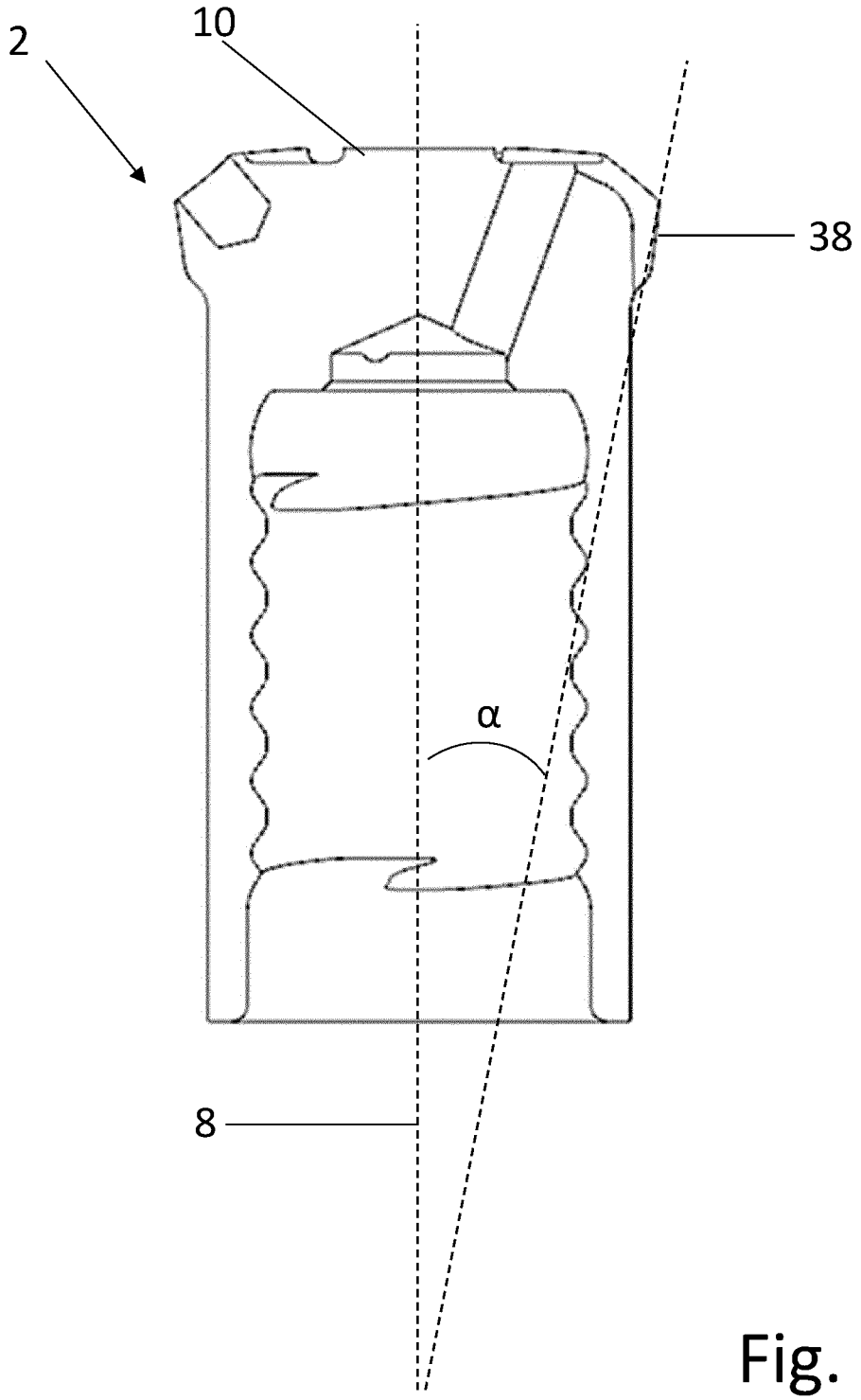
FIG. 3: Cross sectional view of the drill bit.

FIG. 3 shows a cross section of the drill bit 2. The bit head clearance angle, $\alpha$, is the angle between the axis 8 a side surface 38 of the gauge 14. In one embodiment of the invention, $\alpha$ is $\geq 5°$, preferably $\geq 6°$. In one embodiment of the invention $\alpha$ is $\leq 12°$, preferably $\leq 9°$.

The drill bit 2 described hereinabove and below could be used on any percussion drilling equipment, for example a top hammer drill or a down-the-hole (DTH) drill.

The invention claimed is:

1. A drill bit comprising:

a shank;

a drill bit head, the drill bit head and the shank both being centered on a longitudinal axis, wherein the drill bit head has a gauge and a front face with a peripheral edge, which is adjacent to the gauge, the peripheral edge having a diameter D1, an area within the peripheral edge defining a total area of the front face, wherein the front face has a central island at its radially innermost section, a plurality of peripheral platforms at its radially outermost section adjacent to the peripheral edge and a recessed section positioned radially between the central island and the peripheral platforms, wherein the central island and the peripheral platforms are axially raised in comparison to the recessed section;

a plurality of inner front inserts positioned on the central island; and at least one outer front insert positioned on each of the peripheral platforms, wherein an area of the recessed section is >62% of the total area of the front face.

2. The drill bit according to claim 1, wherein the area of the recessed section is >63% of the total area of the front face of the drill bit head.

3. The drill bit according to claim 1, wherein the area of the recessed section is <80% of the total area of the front face of the drill bit head.

4. The drill bit according to claim 1, wherein the recessed section extends in between each of the outer front inserts on each of the peripheral platforms to a recessed section outer edge having a diameter, D2, wherein D2 is >70% of D1.

5. The drill bit according to claim 4, wherein D2 is up to 100% of D1.

6. The drill bit according to claim 1, wherein the recessed section extends in between each of the inner front inserts on the peripheral platforms to a recessed section inner edge having a diameter, D3, wherein D3 is <40% of D1.

7. The drill bit according to claim 6, wherein D3 is >10% of D1.

8. The drill bit according to claim 1, wherein the recessed section is at least 1.0 mm from the inner and outer inserts.

9. The drill bit according to claim 1, wherein the gauge has a side surface and wherein an angle, $\alpha$, between the axis and the side surface is $\geq 5°$.

10. The drill bit according to claim 9, wherein $\alpha$ is $\leq 12°$.

11. The drill bit according to claim 1, wherein there are between 2 and 4 inner front inserts positioned on the central island.

12. The drill bit according to claim 1, wherein there are between 1 and 3 outer front face inserts positioned on each of the peripheral platforms.

13. The drill bit according to claim 1, wherein there are between 3 and 8 peripheral platforms.

14. The drill bit according to claim 1, wherein the peripheral platform has a width of less than 2.5 mm around at least 10% of a circumference of each of the outer front inserts.

15. The drill bit according to claim 1, wherein the central island has a width of less than 2.5 mm around at least 50% of a circumference of each of the inner front inserts.

* * * * *